US009097478B1

(12) United States Patent
Karagias

(10) Patent No.: US 9,097,478 B1
(45) Date of Patent: Aug. 4, 2015

(54) BOLT MECHANISMS AND FIREARMS CONTAINING THE SAME

(71) Applicant: Theodore Karagias, Seattle, WA (US)

(72) Inventor: Theodore Karagias, Seattle, WA (US)

( * ) Notice: Subject to any disclaimer, the term of this patent is extended or adjusted under 35 U.S.C. 154(b) by 0 days.

(21) Appl. No.: 13/771,021

(22) Filed: Feb. 19, 2013

Related U.S. Application Data

(60) Provisional application No. 61/600,477, filed on Feb. 17, 2012, provisional application No. 61/602,520, filed on Feb. 23, 2012.

(51) Int. Cl.

| | |
|---|---|
| ***F41A 15/10*** | (2006.01) |
| ***F41A 15/00*** | (2006.01) |
| ***F41A 15/12*** | (2006.01) |
| ***F41A 15/08*** | (2006.01) |

(52) U.S. Cl.
CPC ..... *F41A 15/00* (2013.01); *F41A 15/08* (2013.01); *F41A 15/10* (2013.01); *F41A 15/12* (2013.01)

(58) Field of Classification Search
CPC ..... F41A 15/08; F41A 15/10; F41A 15/12
USPC ..... 42/25
See application file for complete search history.

(56) References Cited

U.S. PATENT DOCUMENTS

| | | | | |
|---|---|---|---|---|
| 119,939 | A * | 10/1871 | Merrill | 42/20 |
| 467,180 | A | 1/1892 | Mauser | |
| 477,671 | A | 6/1892 | Mauser | |
| 3,253,362 | A * | 5/1966 | Gitchell | 42/16 |
| 3,979,849 | A | 9/1976 | Haskins | |
| 4,054,003 | A | 10/1977 | Wilson | |
| 4,085,511 | A | 4/1978 | Kovac | |
| 4,547,988 | A | 10/1985 | Nilsson | |
| 4,671,005 | A | 6/1987 | Jewell | |
| 4,698,931 | A | 10/1987 | Larsson | |
| 4,920,677 | A | 5/1990 | Schuerman | |
| 4,937,964 | A | 7/1990 | Crandall | |
| 5,096,155 | A | 3/1992 | Fitzgerald | |
| 5,205,942 | A | 4/1993 | Fitzgerald | |
| 5,787,629 | A | 8/1998 | Campbell et al. | |
| 5,813,158 | A | 9/1998 | Campbell et al. | |
| 6,293,203 | B1 | 9/2001 | Alexander et al. | |
| 6,305,113 | B1 | 10/2001 | Calvete | |
| 6,345,460 | B2 | 2/2002 | Hashman | |
| 6,401,378 | B1 | 6/2002 | Ockenfuss | |
| 6,508,025 | B1 | 1/2003 | Du Plessis | |
| 6,532,876 | B1 | 3/2003 | Ramirez et al. | |
| 6,594,938 | B2 | 7/2003 | Horton | |
| 6,625,917 | B2 * | 9/2003 | Murello et al. | 42/16 |
| 6,634,129 | B1 | 10/2003 | Freeman, Jr. | |
| 6,679,150 | B1 | 1/2004 | Ramirez et al. | |
| 6,681,511 | B1 | 1/2004 | Huber | |
| 6,925,744 | B2 | 8/2005 | Kincel | |
| 7,051,467 | B1 | 5/2006 | Huber | |
| 7,363,740 | B2 | 4/2008 | Kincel | |
| 7,430,827 | B1 | 10/2008 | Huber | |
| 7,596,900 | B2 | 10/2009 | Robinson et al. | |
| 7,827,724 | B1 | 11/2010 | Spinelli | |
| 8,099,895 | B2 | 1/2012 | Farley, Jr. et al. | |
| 8,215,045 | B2 | 7/2012 | Mitchell | |
| 8,230,633 | B1 | 7/2012 | Sisk | |

* cited by examiner

*Primary Examiner* — Stephen M Johnson
(74) *Attorney, Agent, or Firm* — Perkins Coie LLP

(57) ABSTRACT

A firearm includes a bolt mechanism with a bolt configured to receive a firing pin assembly and a bolt head assembly. The bolt head assembly includes a pivoting bolt head and an extractor. The extractor is positioned relative to the bolt such that substantially all forces applied by the extractor to the bolt mechanism are reacted within the bolt head assembly. A biasing member or element can urge a claw portion of extractor towards a distal end of the bolt head.

26 Claims, 10 Drawing Sheets

BOLT MECHANISMS AND FIREARMS CONTAINING THE SAME

CROSS-REFERENCE TO RELATED APPLICATIONS

This application claims the benefit under 35 U.S.C. §119 (e) of U.S. Provisional Patent Application No. 61/600,477 filed Feb. 17, 2012 and U.S. Provisional Patent Application No. 61/602,520 filed Feb. 23, 2012. These two provisional applications are incorporated herein by reference in their entireties.

TECHNICAL FIELD

The present invention relates generally to bolt mechanisms for firearms. More specifically, the invention relates to bolt mechanisms having an extractor and firearms containing the same.

BACKGROUND

Bolt-action rifles often have extractors for receiving cartridges from magazines and removing empty cartridge shells from firing chambers. U.S. Pat. No. 467,180 discloses a bolt system that includes an extractor for removing empty cartridge shells. The extractor is pivotally coupled to a bolt head such that a rearward end of the extractor contacts an outer surface of a bolt. The bolt reacts the force applied by the rearward end of the extractor such that the extractor body provides a spring force. Because the bolt reacts the forces applied by the extractor, the bolt is fixedly coupled to the bolt head to ensure that the bolt head is properly aligned. Unfortunately, bolt heads often improperly seat with the body of the barrel, thereby impairing performance of the rifle. For example, gaps between lugs of the bolt head and breech (or barrel extender) may result in movement of components (e.g., bolt head and bolt) and misalignment of the bolt face and/or excessive wear/damage when large pressures build up in the firing chamber during firing.

SUMMARY

At least some embodiments disclosed herein are directed to a bolt mechanism including a bolt and a bolt head assembly. The bolt head assembly includes a floating bolt head and an extractor. Substantially all loads applied by the extractor can be reacted within the bolt head assembly. For example, the extractor can receive and hold shells of cartridges without applying forces directly to the bolt. The bolt head assembly can internally react forces associated with movement of the extractor to, for example, maintain contact between the bolt head and other component(s) of the firearm. In some embodiments, the bolt head rotates relative to the bolt to keep a bearing surface of lugs of the bolt head assembly substantially flat against a shoulder (e.g., a bearing shoulder which is part of the receiver, barrel extension, barrel, breech, etc.) or other feature(s) for bearing loads, such as loads imparted by pressures during firing.

The extractor, in some embodiments, is biased against the bolt head without applying loads directly to the bolt, and the extractor can be moved without influencing seating of the bolt head. The extractor can be biased by a biasing member, including one or more integral biasing members (e.g., cantilevered portions) or springs. The bolt head, in some embodiments, can pivot relative to the bolt about two axes of rotation. The axes of rotation can be generally perpendicular to one another or at other suitable orientations. In one embodiment, the bolt head can rotate while the bolt is in a locked position to seat the lugs (e.g., locking lugs) against bearing surfaces of, for example, a barrel, a barrel extension, or other component of the firearm.

In some embodiments, a bolt mechanism for a firearm includes a bolt and a bolt head assembly. The bolt is configured to receive a firing pin assembly. The bolt head assembly is coupled to a bolt and includes a bolt head and an extractor. The bolt head assembly is configured to react substantially all forces applied to the bolt mechanisms by the extractor. In one embodiment, the extractor is pivotally coupled to a collar of the bolt head assembly. A biasing member can urge the extractor towards an engagement position such that a claw portion of the extractor is positioned to receive a shell (or case) of a cartridge. The bolt head can be pivotally coupled and translationally fixed to the bolt.

In some embodiments, a bolt mechanism includes a bolt, a bolt head, and an extractor. The extractor can only contact surfaces of a bolt head assembly. The extractor can be biased without applying a force or a torque that causes relative movement between the bolt and the bolt head.

In some embodiments, a bolt mechanism for a firearm includes a bolt and a bolt head assembly. The bolt has a longitudinal axis of rotation. The bolt head assembly is coupled to the bolt and includes a bolt head and an extractor. The extractor is non-rotating about the longitudinal axis of the bolt. In one embodiment, the extractor is positioned relative to the bolt such that substantially all forces associated with, for example, biasing of the extractor. In one embodiment, all of the forces applied by the extractor to the bolt mechanism are reacted within the bolt head assembly while the bolt mechanism is positioned in the firearm.

In one embodiment, the extractor can slide proximally or distally as the bolt mechanism is moved proximally or distally, respectively. While the bolt is rotated, the extractor can be non-rotating about the bolt longitudinal axis. In certain embodiments, the bolt head assembly includes a pin and a non-rotating collar positioned between a head portion of the bolt head and the bolt. The pin rotatably couples the extractor to the non-rotating collar.

A bolt mechanism can include a bolt and a bolt head assembly. The bolt is configured to receive a firing pin assembly and has a longitudinal axis of rotation. The bolt head assembly is coupled to the bolt and includes a floating bolt head and an extractor. The extractor is non-rotating about the longitudinal axis of the bolt mechanism or an axis of a firearm. When the bolt mechanism is moved from an open position and a closed position, the extractor translates (without rotation about the longitudinal axis of the bolt) along the firearm.

In some embodiments, a bolt mechanism includes a bolt having a longitudinal axis and a separate bolt head assembly coupled to the bolt. The bolt head assembly includes an extractor rotatable about the longitudinal axis of the bolt when the bolt head assembly is uninstalled. In one embodiment, the bolt head assembly further comprises a floating bolt head. The extractor is positioned relative to the bolt such that substantially all forces applied by the extractor to the bolt mechanism are reacted within the bolt head assembly when the bolt mechanism is positioned in the firearm. The bolt head assembly further comprises a floating bolt head that is rotatable about two axes of rotation. The two axes can be substantially perpendicular to the longitudinal axis.

BRIEF DESCRIPTION OF THE DRAWINGS

Non-limiting and non-exhaustive embodiments are described with reference to the following drawings. The same reference numerals refer to like parts throughout the various views, unless otherwise specified.

DETAILED DESCRIPTION

The present technology is generally directed to firearms, bolt mechanisms, extractors, and methods of using the same. Specific details of numerous embodiments of the technology are described below with reference to FIGS. 1-17. A person of ordinary skill in the art will understand that the technology can have other embodiments with additional elements and features, or the technology can have other embodiments without several of the features shown and described below with reference to FIGS. 1-17. The terms "proximal" and "distal" are used to describe the illustrated embodiments and are used consistently with the description of non-limiting exemplary applications. The terms proximal and distally are used in reference to the user's body when the user fires a firearm, unless the context clearly indicates otherwise.

Figure 1:
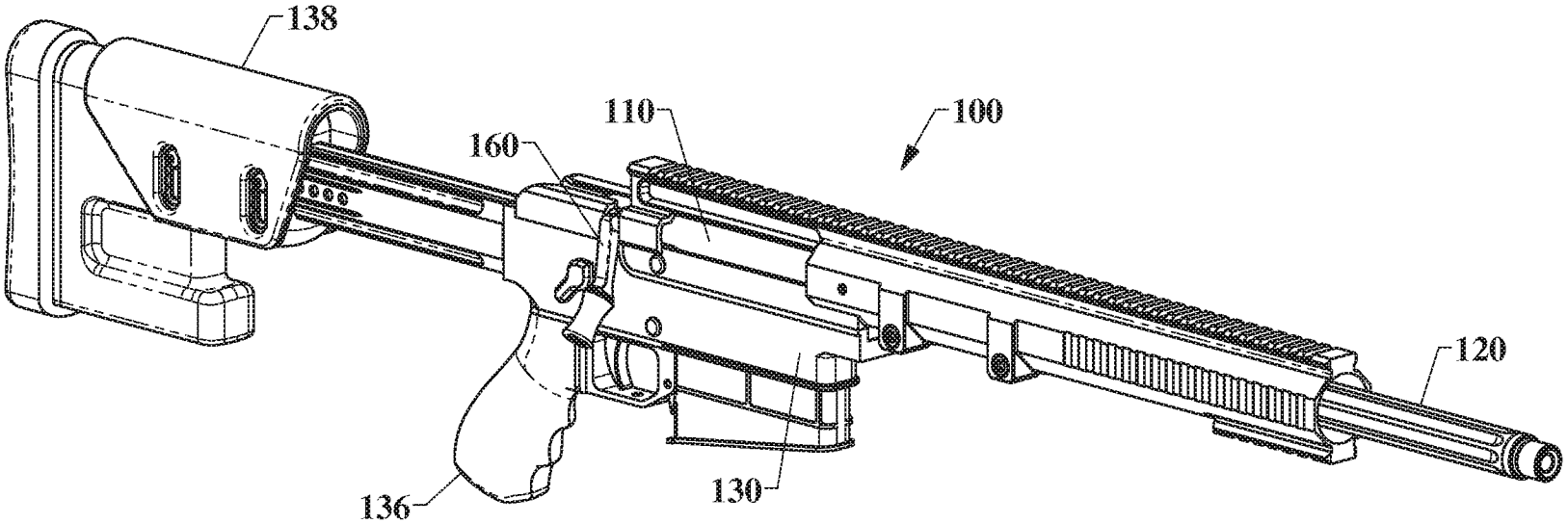
FIG. 1 is an isometric view of a firearm with a bolt mechanism in a closed position in accordance with one embodiment.
Figure 2:
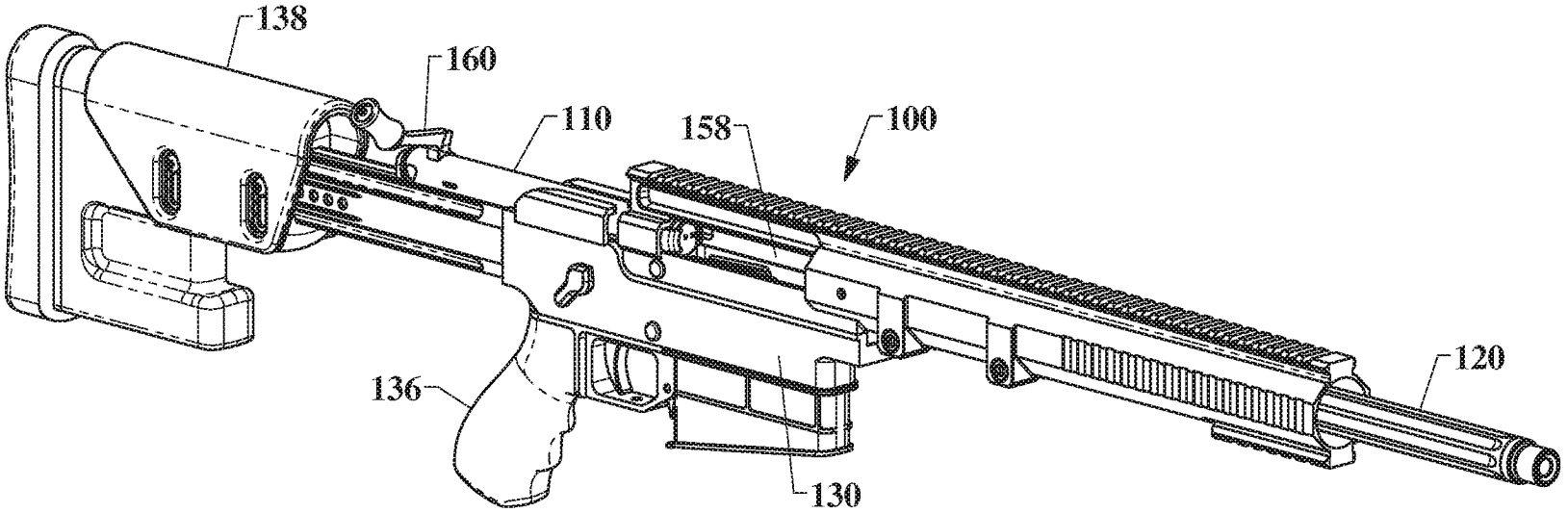
FIG. 2 is an isometric view of the firearm of FIG. 1 with the bolt mechanism in an open position in accordance with one embodiment.

FIGS. 1 and 2 are isometric views of a firearm 100 in accordance with one embodiment. The firearm 100 can include a bolt mechanism 110, a barrel 120, a main body or receiver assembly 130, a grip 136, and a stock 138. The bolt mechanism 110 can receive and hold a shell (or case) of a cartridge. After firing the projectile, the bolt mechanism 110 can be moved from a locked or closed position (FIG. 1) to the open position (FIG. 2) to eject the empty shell. For example, a handle 160 can be rotated to unlock the bolt mechanism 110, and the bolt mechanism 110 can be slid proximally to extract the empty shell from the firearm 100 through an ejection port 158 (FIG. 2).

Figure 3:
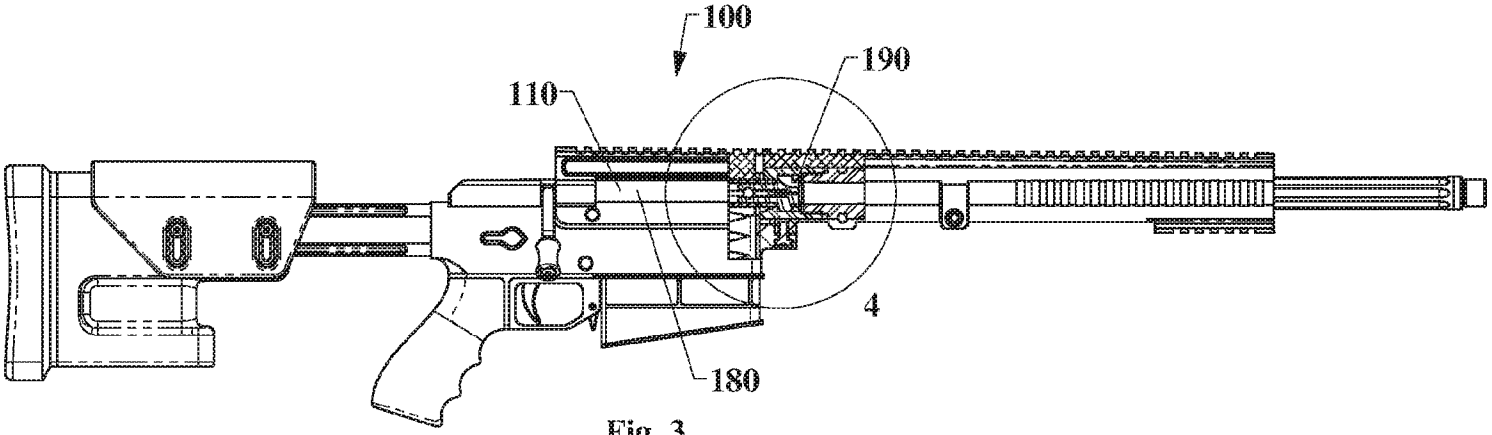
FIG. 3 is a partial cross-sectional view of the firearm of FIG. 1.
Figure 4:
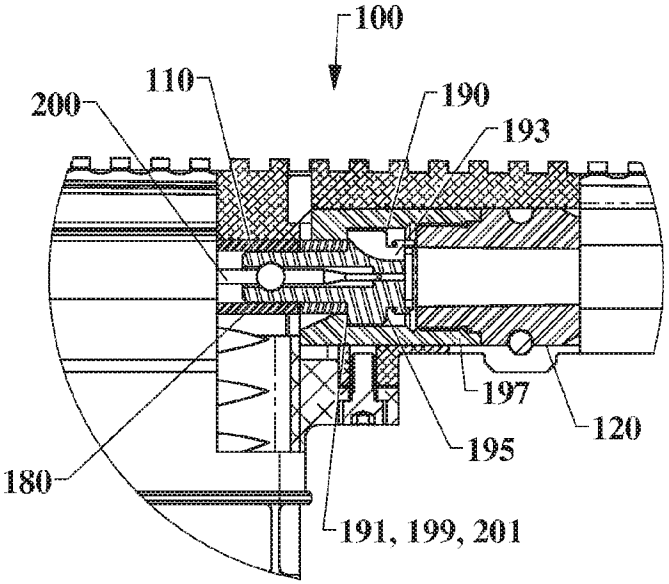
FIG. 4 is a detailed view of the firearm of FIG. 3.

FIG. 3 is a partial cross-sectional view of the firearm 100 with the bolt mechanism 110 in the closed position. FIG. 4 is a detailed cross-sectional view of a portion of the firearm 100. Referring to FIG. 4, the bolt mechanism 110 can include a bolt 180 and a bolt head assembly 190. The bolt head assembly 190 can move to, for example, maintain contact between a bolt head 193 and the barrel 120. For example, an extractor of the bolt head assembly 190 can apply forces to other components of the bolt head assembly 190 to allow floating of the bolt head 193 such that contact is maintained between a bearing surface 191 of the bolt head 193 (e.g., a surface of a bolt lug 195) and a bearing member 197. The bearing member 197 can be a barrel extender. A back surface 199 of the bolt head 193 can bear against a shoulder 201. As a result, the bearing surface 191 can lay flat against the surface of the bearing member 197 and the back surface 199 can lay flat against the surface of the shoulder 201 to limit, inhibit, or substantially eliminate high stresses between the bolt head assembly 190 and the adjacent components, as well as maintaining alignment of the bolt head 193 throughout firing.

Figure 5:
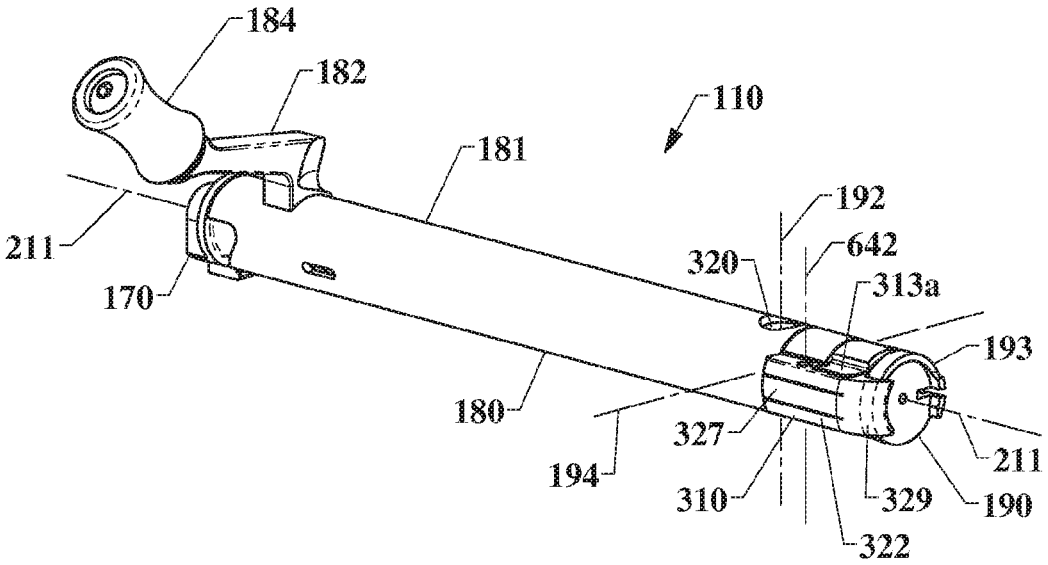
FIG. 5 is an isometric view of a bolt mechanism and a firing pin assembly in accordance with one embodiment.
Figure 5A:
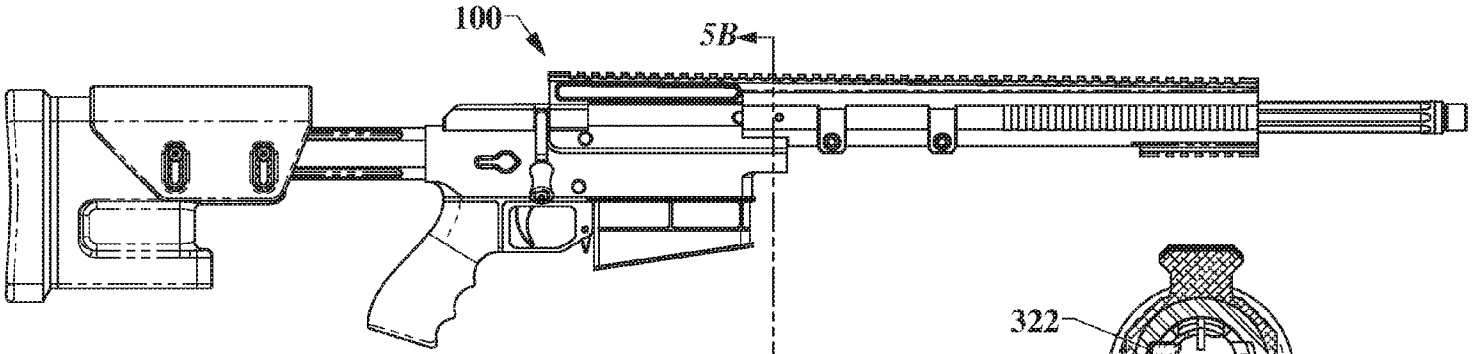
FIG. 5A is a side view of the firearm of FIG. 1.
Figure 5B:
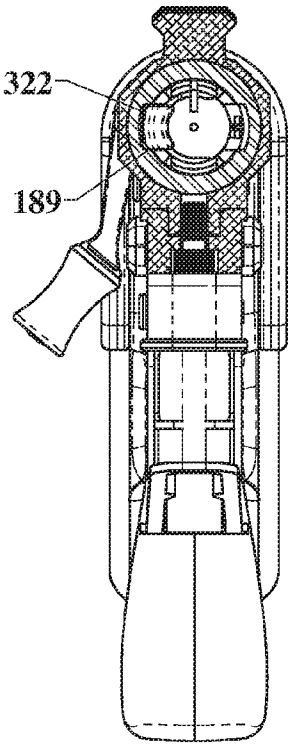
FIG. 5B is a cross-sectional view of the firearm of FIG. 5A taken along line 5B-5B.

FIG. 5 is an isometric view of a firing pin assembly 170 positioned within the bolt mechanism 110. FIG. 5A is a side view of the firearm 100 with the bolt mechanism. FIG. 5B is a cross-sectional view of the firearm of FIG. 5A taken along line 5B-5B. Referring to FIG. 5, the bolt 180 can include a tubular main body 181 and the handle 182 with a knob 184. The handle 182 can be used to rotate lugs 313*a*, 313*b* (FIG. 6) from unlocked positions to locked positions.

Figure 6:
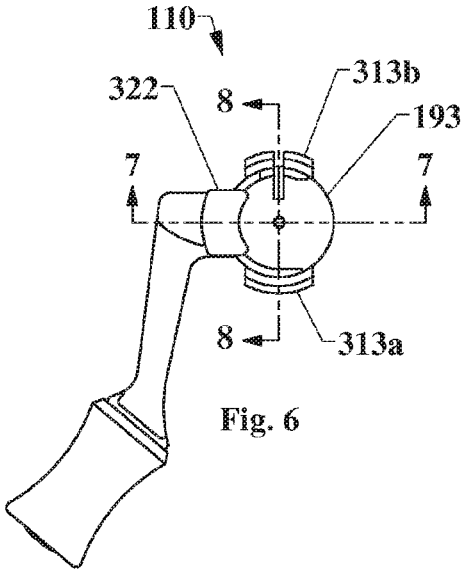
FIG. 6 is a front view of the bolt mechanism of FIG. 5.
Figure 8:
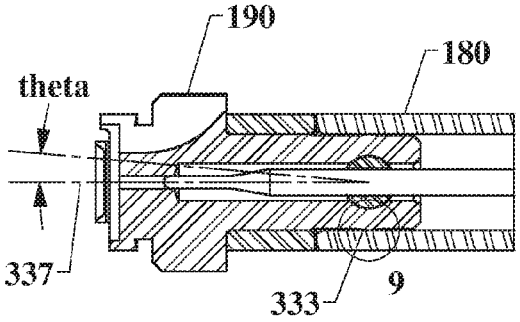
FIG. 8 is a cross-sectional view of the distal portion of the bolt mechanism taken along line 8-8 of FIG. 6.
Figure 7:
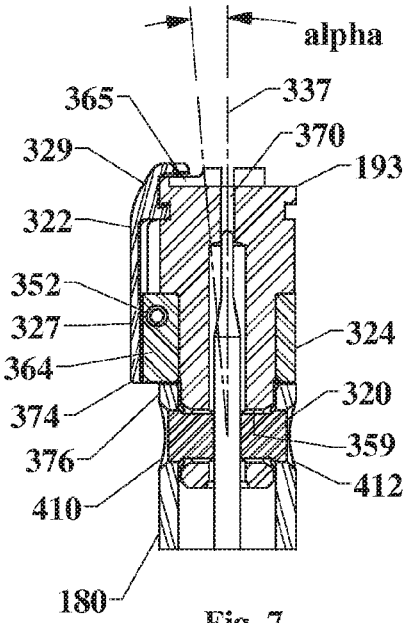
FIG. 7 is a cross-sectional view of a distal portion of the bolt mechanism taken along line 7-7 of FIG. 6.

FIG. 6 is a front view of the bolt mechanism 110. FIG. 7 is a cross-sectional view of a distal portion of the bolt mechanism 110 taken along line 7-7 of FIG. 6. FIG. 8 is a cross-sectional view of the distal portion of the bolt mechanism 110 taken along line 8-8 of FIG. 6. Referring to FIGS. 5 and 7, the bolt head assembly 190 can further include an extractor assembly 310 and a pin 352 (FIG. 7). The extractor assembly 310 can include an extractor 322 and a collar 324 that cooperate to react substantially all applied loads associated with the extractor 322 within the bolt head assembly 190 to allow rotation of the bolt head 193. Thus, the bolt head 193 is a floating bolt head. For example, the forces applied by the extractor 322 can be reacted by the collar 324, or other component of the bolt head assembly 190. As such, the bolt 180 does not react applied forces associated with the extractor 322, such that bolt head 193 can freely rotate relative to the bolt 180. While the bolt head 193 rotates, the extractor 322 can remain spaced apart from the bolt 180 and positioned in a feature 189 of FIG. 5B (e.g., a channel or a slot) extending longitudinally along the firearm 100. As such, the extractor 322 can be substantially non-rotating about a longitudinal axis 211 (FIG. 5) of the bolt 180. As the bolt 180 rotates about its longitudinal axis 211, the firearm 100 can maintain the angular position of the extractor 322. The firearm 110 can constrain the extractor 322 to prevent rotation of the extractor about the longitudinal axis 211. When the bolt mechanism 110 is uninstalled, the extractor 322 can the bolt 180 can rotate together. When the bolt mechanism 110 is installed in the firearm 100, the extractor 322 is non-rotatable the longitudinal axis 211 because the firearm 100 constrains the extractor 322.

In some embodiments, including the illustrated embodiment, bolt head 193 can freely rotate about the two axes of rotation 192, 194 (FIG. 5). When the bolt head 193 is in a maximum rotated position relative to the transverse axis of rotation 194 of FIG. 5, a longitudinal axis 337 of the bolt head 193 can define an angle of rotation $\alpha$ of FIG. 7. (FIG. 7 shows the bolt head 193 in an unrotated or central position.) When the bolt head 193 is in a maximum rotated position relative to the transverse axis of rotation 192 of FIG. 5, the longitudinal axis 337 can define an angle θ of FIG. 8. (FIG. 8 shows the bolt head 193 in the unrotated or central position.) In some embodiments, the angles θ, α can be equal to or less than about 5 degrees, 3 degrees, 2 degrees, or 1.5 degrees. In one embodiment, one or both angles θ, α can be equal to or less than about 3 degrees. Other angles are also possible.

Figure 9:
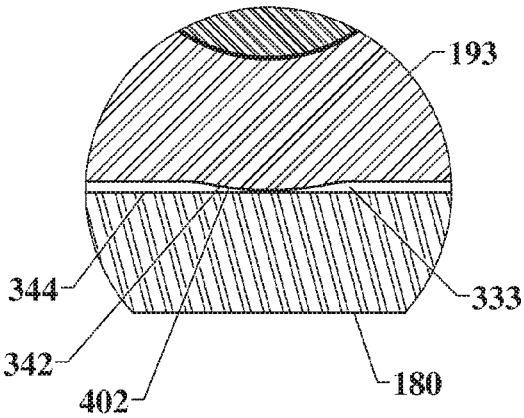
FIG. 9 is a detailed view of a joint of the bolt mechanism of FIG. 8.

FIG. 9 is a detailed view of a joint 333 of the bolt mechanism 110. As used herein, the term "joint" is a broad term that includes, but is not limited to, the region of contact between two elements that permits relative movement between the two elements. The term "rotational joint" is a broad term that includes, without limitation, a joint that has at least one rotational degree of freedom with substantially no axial movement in at least one direction. For example, a rotational joint can be in the form of a swivel joint or pivot joint. A pivot joint includes, without limitation, a joint that is generally rotationally unrestrained in at least two rotational degrees of freedom. The joint 333 of FIG. 9 is a pivot joint with two rotational degrees of freedom. The bolt head 193 can include a surface 342 of a pivoting feature 402 that mates with an inner surface 344 of the bolt 180. In some embodiments, the surface 342 is a curved surface, such as a partially spherical surface with a radius curvature selected based on the desired movement (e.g., pivoting, rolling, sliding, etc.) along the surface 344 of the bolt 180.

Referring to FIGS. 5 and 7, a pin 320 can limit or prevent axial movement of the bolt head 193. A gap 359 (FIG. 7) between the pin 320 and bolt head 193 can allow rotation of the bolt head 193. The extractor 322 can include a biasing member 327 and a claw portion 329. The biasing member 327 can urge the extractor 322 towards an engagement position for receiving a rim of cartridge shell in a slot 365 (FIG. 7). As shown in FIG. 7, the biasing member 327 can contact a protrusion or mounting portion 364 of the collar 324 to urge the claw portion 329 inwardly towards a firing pin hole 370. A rearward or proximal end 374 of the extractor 322 is spaced apart of an outer surface 376 of the bolt 180. In some embodiments, the extractor proximal end 374 is positioned distal of one or both axes of rotation 192, 194, but the extractor proximal end 374 can be at other locations.

Figure 10:
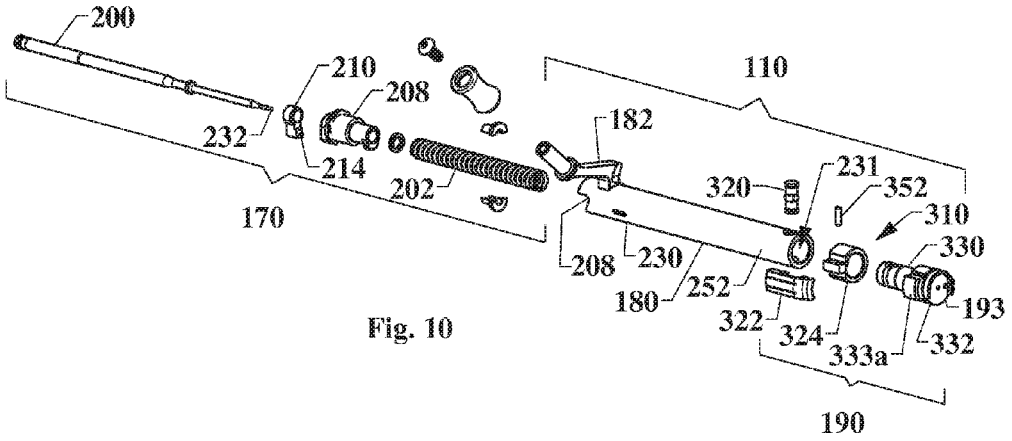
FIG. 10 is an exploded isometric view of a bolt mechanism and firing pin assembly in accordance with one embodiment.

FIG. 10 is an exploded isometric view of the bolt mechanism 110 and the firing pin assembly 170. The firing pin assembly 170 can include a firing pin 200, a firing pin spring 202, a bolt shroud 208, and a cocking piece 210. The cocking piece 210 has a cam member 214, which can be engaged by firing pin cam 208 of the bolt 180. The bolt shroud 208 may also be referred to as a bolt sleeve, and the cocking piece 210 may also be referred to as a striker. The firing pin assembly 170 can be assembled and inserted into a proximal end 230 of the bolt 180. The firing pin assembly 170 can be advance distally through a passageway 231 defined by a sidewall 252 of the bolt 180 to position a tip 232 of the firing pin 200 within the bolt head assembly 190. Other types of firing pin assemblies can be used with the bolt mechanism 110.

The bolt head 193 can include a pin portion 330, a head portion 332, and lugs 333*a*, 333*b*. The lugs 333*a*, 333*b* can be used to lock the bolt mechanism 110 to the receiver, or other component of the firearm. The pin portion 330 can be inserted through the collar 324 and into a distal portion of the passageway 231. The configuration and features of the bolt head 193 can be selected based on, for example, the desired motion of the bolt head 193.

Figure 11:
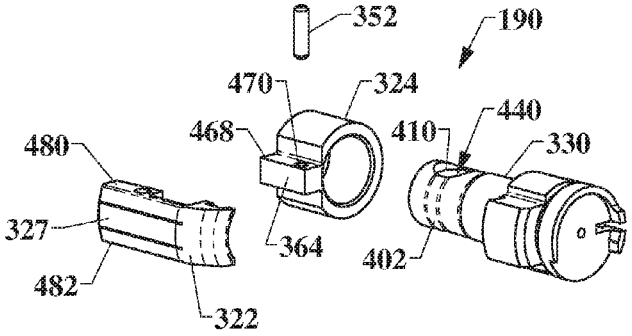
FIG. 11 is an exploded view of a bolt head assembly in accordance with one embodiment.

FIG. 11 is an exploded isometric view of the bolt head assembly 190. The pin portion 330 includes a through hole 440 and a pivoting feature 402. The pivoting feature 402 extends circumferentially between an ends 410, 412 (see FIG. 7) of the through hole 440. The pin 352 can be positioned in the opening 470 to rotatably couple the extractor 322 to the collar 324. The biasing member 327 can engage the outer surface of the mounting portion 364 and can extend generally longitudinally along the bolt mechanism 110.

Figure 12:
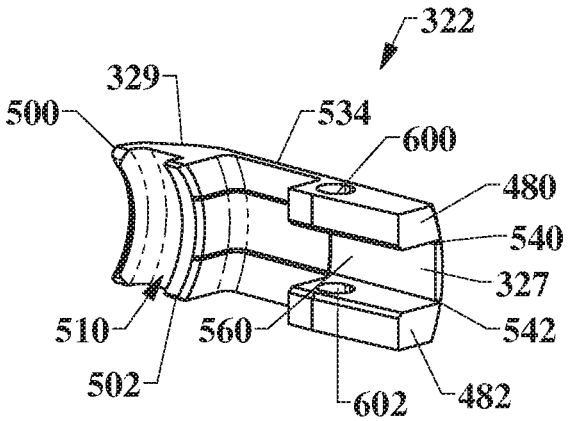
FIGS. 12 and 13 are isometric views of an extractor in accordance with one embodiment.
Figure 13:
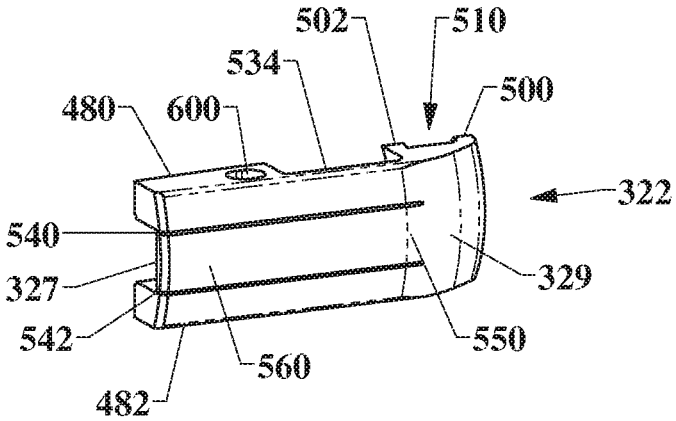

FIGS. 12 and 13 are isometric views of the extractor 322 including a claw portion 329 and a main body 534. The claw portion 329 can include projections 500, 502 in the form of arcuate lips that define a channel 510 for receiving a rim of a shell. When the extractor 322 is pulled proximally, the projection 500 can pull the empty shell out of the firing chamber. The claw portion 329 can have other features and configurations. The main body 534 can include two elongated slots 540, 542 (e.g., slots formed by a cutting process) that define the biasing member 327, which can be a cantilevered member with a mounting end 550 (FIG. 13) connected to the claw portion 329. An elongated body 560 of the biasing member 327 can extend generally longitudinally along the bolt mechanism 110, but the elongated body 560 can be at other orientations. The extractor 322 can be made, in whole or in part, of metal (e.g., steel, aluminum, etc.), plastic, or the like.

Referring to FIGS. 11-13, the mounting portion 364 of the collar 324 can be positioned between mounting portions 480, 482 of the extractor 322. The pin 352 can be inserted through openings 600, 470, 602 to define an axis of rotation 642 (FIG. 5) about which the extractor 322 rotates. When the claw portion 329 is moved away from the bolt head 193, the biasing member 327 can be pressed against the portion 364 to urge the extractor 322 back towards the bolt head 193. Both the pin 352 and collar 324 can be non-rotating about the longitudinal axis of the bolt 180 when installed in the firearm.

Figure 14:
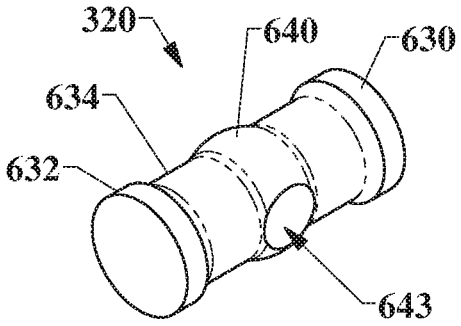
FIG. 14 is an isometric view of a pin in accordance with one embodiment.

FIG. 14 is an isometric view of the pin 320 including heads 630, 632 and a main body 634. A pivoting feature 640 is positioned along the main body 634. A through hole 643 can extend transversely through the main body 634. In some embodiments, the pivoting feature 640 can have a partially spherical surface or curved surface suitable for moving (e.g., pivoting, rolling, sliding, etc.) along another surface. In one embodiment, the pivoting feature 640 is a band having a curved surface.

Figure 15:
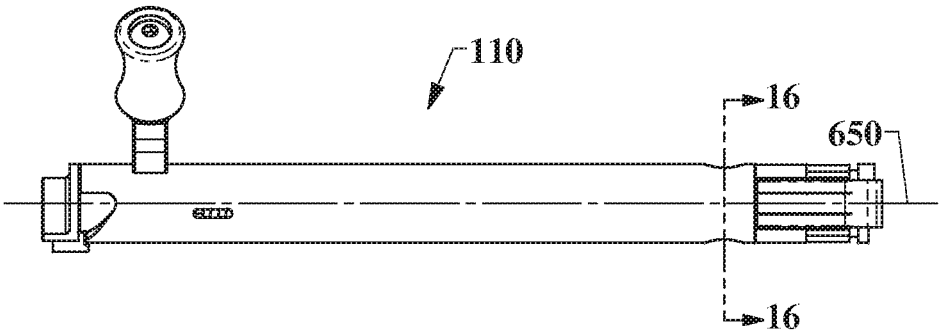
FIG. 15 is a side view of a bolt mechanism in accordance with one embodiment.
Figure 16:
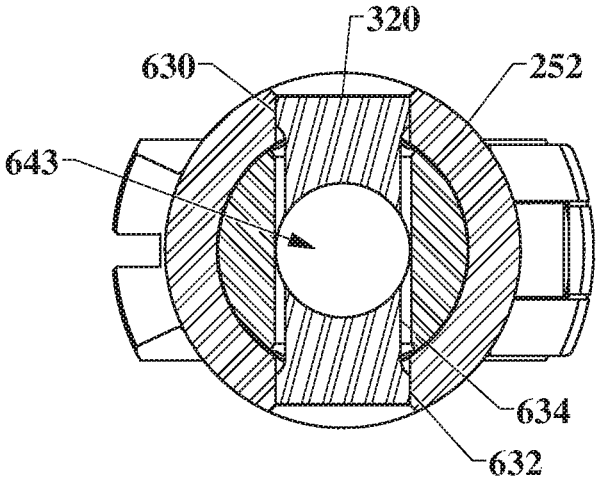
FIG. 16 is a cross-sectional view of the bolt mechanism taken along line 16-16 of FIG. 15.

FIG. 15 is a side view of the bolt mechanism 110. FIG. 16 is a cross-sectional view of the bolt mechanism 110 along line 16-16 of FIG. 15. Referring to FIGS. 15 and 16, the through hole 643 (FIG. 16) can be longitudinally aligned with a longitudinal axis 650 (FIG. 15) of the bolt mechanism 110. The firing pin 200 (FIG. 10) can be inserted through the through hole 643 to position the firing pin 200 within the bolt head 193. The heads 630, 632 of the pin 320 can engage the sidewall 252 of the bolt 180.

Figure 17:
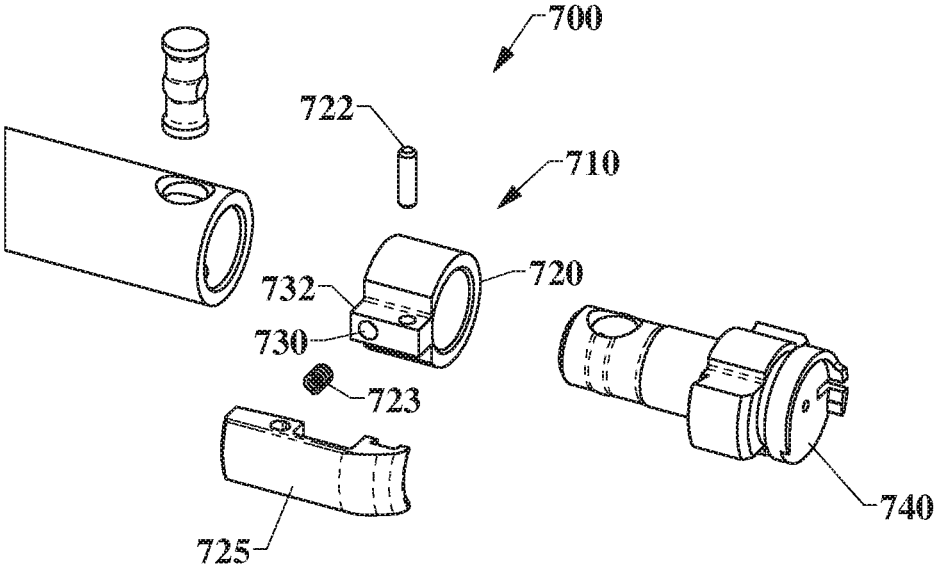
FIG. 17 is an exploded view of a bolt head assembly in accordance with one embodiment.

FIG. 17 is an exploded isometric view of a bolt head assembly 700 in accordance with one embodiment. The bolt head assembly 700 is generally similar to the bolt head assembly 190 discussed in connection with FIGS. 1-16, except as detailed below. The bolt head assembly 700 includes an extractor assembly 710 including a collar 720, a pin 722, a biasing member 723, and an extractor 725. The biasing member 723 can be partially received within an opening 730 of a protrusion or mounting portion 732. In some embodiments, the biasing member 723 can be a helical spring, a coil spring, or other biasing device made of metal, plastic, or other suitable materials capable of urging the extractor 725 towards a distal end of the bolt head 740. The biasing member 723 can be compressed as the extractor claw portion moves away from the bolt head 740. In other embodiments, the extractor assembly 710 can include two springs, each with different spring characteristics. The extract 725 can pivot about the pin 722 without applying forces to the bolt 180.

The embodiments, features, extractors, bolt mechanism, methods and techniques described herein may, in some embodiments, be similar to any one or more of the embodiments, mounting clamps, features, systems, devices, materials, methods and techniques described in U.S. Pat. No. 7,743,543; U.S. Provisional Patent Application No. 61/600,477; and U.S. Provisional Patent Application No. 61/602,520. U.S. Pat. No. 7,743,543 is incorporated herein by reference in its entirety. In addition, the embodiments, features, systems, devices, materials, methods and techniques described herein may, in certain embodiments, be applied to or used in connection with any one or more of the embodiments, features, systems, devices, materials, methods and techniques disclosed in the above-mentioned U.S. Pat. No. 7,743,543; U.S. Provisional Patent Application No. 61/600,477; and U.S. Provisional Patent Application No. 61/602,520. For example, the mounting clamps and this features disclosed in U.S. Pat. No. 7,743,543 may incorporate the embodiments disclosed herein. The bolt mechanisms and other features disclosed herein can be incorporated in into a wide range of different firearms (e.g., rifle, pistol, or other portable guns) to receive cartridges and removing empty cartridge shells.

From the foregoing, it will be appreciated that specific embodiments of the invention have been described herein for purposes of illustration, but well-known structures and functions have not been shown or described in detail to avoid unnecessarily obscuring the description of at least some embodiments of the invention. Where the context permits, singular or plural terms may also include the plural or singular term, respectively. Unless the word "or" is associated with an express clause indicating that the word should be limited to mean only a single item exclusive from the other items in reference to a list of two or more items, then the use of "or" in such a list shall be interpreted as including (a) any single item in the list, (b) all of the items in the list, or (c) any combination of the items in the list. The singular forms "a," "an," and "the" include plural referents unless the context clearly indicates otherwise. Thus, for example, reference to "a lug" refers to one or more lugs, such as two or more lugs, three or more lugs, or four or more lugs.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A bolt mechanism for a firearm, comprising;

a bolt configured to receive a firing pin assembly and having a longitudinal axis; and a bolt head assembly coupled to an end of the bolt and including an extractor and a floating bolt head, wherein the bolt is rotatable relative to the extractor such that the bolt mechanism moves from a closed position to an open position while the extractor does not rotate about a longitudinal axis of the bolt mechanism when the bolt mechanism is installed in the firearm, wherein the floating bolt head is rotatable about two axes of rotation relative to the bolt, and wherein the two axes of rotation are substantially perpendicular to the longitudinal axis of the bolt.

2. The bolt mechanism of claim 1, wherein the extractor is positioned relative to the bolt such that substantially all forces applied by the extractor to the bolt mechanism are reacted within the bolt head assembly when the bolt mechanism is positioned in the firearm.

3. The bolt mechanism of claim 1, wherein the extractor is configured such that substantially all forces applied by the extractor to the bolt mechanism are reacted within the bolt head assembly when the bolt mechanism is positioned in the firearm.

4. The bolt mechanism of claim 1, wherein the extractor is non-rotating about the longitudinal axis of the bolt when the bolt mechanism is installed in the firearm.

5. The bolt mechanism of claim 1, wherein the extractor is positioned in a slot that extends longitudinally along the firearm when the bolt mechanism is installed in the firearm.

6. The bolt mechanism of claim 1, wherein the bolt head assembly includes a pin and a non-rotating collar positioned between a head portion of the floating bolt head and the bolt, and wherein the pin rotatably couples the extractor to the non-rotating collar.

7. The bolt mechanism of claim 1, further comprising a collar positioned between the bolt and the bolt head assembly, the extractor including a cantilevered portion that contacts the collar to urge the extractor towards a position for receiving a rim of a shell of a cartridge.

8. The bolt mechanism of claim 1, wherein the extractor includes a claw portion and a biasing member, the claw portion is positioned to receive at least a portion of a case of a cartridge, and the biasing member urges the claw portion towards a firing pin hole of the bolt head of the bolt head assembly.

9. The bolt mechanism of claim 1, wherein the extractor allows the floating bolt head of the bolt head assembly to rotate relative to one or more shoulders of a breech of the firearm.

10. The bolt mechanism of claim 1, wherein the bolt head assembly further comprises a collar, wherein the floating bolt head extends through the collar and into the bolt, and wherein the extractor is rotatably coupled to the collar.

11. The bolt mechanism of claim 1, wherein the bolt head assembly includes a partially spherical surface that contacts a sidewall of the bolt.

12. The bolt mechanism of claim 1, further comprising a pin rotatably coupling the floating bolt head to the bolt, the pin including a partially spherical surface that contacts a surface of the floating bolt head surrounding the pin.

13. A firearm comprising the bolt mechanism of claim 1.

14. A bolt mechanism for a firearm, comprising:

a bolt; and a bolt head assembly including a bolt head, a pin pivotally coupling the bolt head to the bolt such that the bolt head is rotatable about two axes of rotation relative to the bolt, wherein the bolt head and the bolt rotate together about a longitudinal axis of the bolt when the bolt mechanism is moved from a closed position to an open position while the bolt mechanism is positioned in the firearm, an extractor collar, an extractor claw portion rotatable coupled to the collar and configured to engage a shell of a cartridge wherein the extractor claw portion is non-rotatable about the longitudinal axis of the bolt about which the bolt rotates when the bolt mechanism is moved from the closed position to the open position so as to rotate the bolt head relative to the extractor collar, and a biasing member that biases the extractor claw portion towards the bolt head.

15. The bolt mechanism of claim 14, wherein the bolt head assembly further comprises an extractor with the extractor claw portion, wherein the biasing member is positioned between the extractor and the extractor collar, the biasing member is compressed as the extractor claw portion moves away from the bolt head.

16. The bolt mechanism of claim 14, further comprising an extractor including a proximal portion with the biasing member and a distal portion with the extractor claw portion.

17. The bolt mechanism of claim 14, wherein the bolt head floats relative to the bolt.

18. The bolt mechanism of claim 14, further comprising a joint defined by a sidewall of the bolt and a partially spherical surface of the bolt head contacting the sidewall.

19. The bolt mechanism of claim 14, wherein the bolt head assembly includes a pin that rotatably couples the extractor to the collar.

20. A firearm comprising the bolt mechanism of claim 14.

21. A firearm, comprising:

a main body; and a bolt mechanism housed in the main body and comprising a bolt having a longitudinal axis; and a bolt head assembly coupled to the bolt and including a floating bolt head rotatable about two axes of rotation relative to the longitudinal axis of the bolt, wherein the two axes of rotation are substantially perpendicular to the longitudinal axis, and an extractor that is non-rotating about the longitudinal axis of the bolt when the bolt mechanism moves from a closed position to an open position, and wherein substantially all forces applied by the extractor to the bolt mechanism are reacted within the bolt head assembly while the bolt mechanism is positioned in the firearm.

22. The firearm of claim 21, wherein the extractor is positioned in a channel of a receiver of the main body.

23. The firearm of claim 21, wherein the bolt and the floating bolt head rotate together about the longitudinal axis when the bolt rotates about the longitudinal axis.

24. The firearm of claim 21, further comprising a pin that couples the floating bolt head to the bolt, wherein the pin has a partially spherical surface positioned within a passageway of the bolt, and wherein the partially spherical surface engages the floating bolt head to define the two axes of rotation.

25. A firearm, comprising:

a main body with a receiver; and a bolt mechanism housed in the main body and including— a bolt having a longitudinal axis and a hollow end; and a bolt head assembly coupled to the hollow end and including an extractor assembly including a collar, an extractor, and a pin rotatably coupling the extractor to the collar, wherein the extractor is non-rotating about the longitudinal axis of the bolt when the bolt mechanism is moved from a closed position to an open position, and a bolt head rotatable about at least two bolt head axes of rotation that are substantially perpendicular to the longitudinal axis of the bolt, wherein the bolt head includes a pin portion and a head portion, wherein the pin portion extends through the collar and into the hollow end of the bolt, wherein the collar is between the two bolt head axes of rotation and the head portion such that substantially all forces applied by the extractor assembly to the bolt mechanism are reacted within the bolt head assembly.

26. The firearm of claim 25, wherein the extractor has a gap between a portion of the extractor holding the pin and a claw of the extractor, wherein the bolt head assembly includes a lug for locking the bolt mechanism to the main body, wherein the lug in an unlocked position is located in the gap, and wherein the lug in a locked position is located outside of the gap to engage the main body.

* * * * *

UNITED STATES PATENT AND TRADEMARK OFFICE

CERTIFICATE OF CORRECTION

PATENT NO. : 9,097,478 B1
APPLICATION NO. : 13/771021
DATED : August 4, 2015
INVENTOR(S) : Theodore Karagias It is certified that error appears in the above-identified patent and that said Letters Patent is hereby corrected as shown below:

In the Claims

In column 7, line 52, in claim 1, delete "comprising;" and insert -- comprising: --, therefor.

In column 8, line 59, in claim 14, delete "rotatable" and insert -- rotatably --, therefor.

In column 8, line 60, in claim 14, delete "cartridge" and insert -- cartridge, --, therefor.

Signed and Sealed this
Twenty-first Day of June, 2016

Michelle K. Lee

Michelle K. Lee
*Director of the United States Patent and Trademark Office*